US008739974B2

(12) United States Patent
TeVault et al.

(10) Patent No.: US 8,739,974 B2
(45) Date of Patent: Jun. 3, 2014

(54) MATTRESS PACKAGE

(75) Inventors: Eric Marshall TeVault, Winston Salem, NC (US); Todd M. Morgan, Kernersville, NC (US); Steven W. Tyree, High Point, NC (US)

(73) Assignee: Sealy Technology, LLC, Trinity, NC (US)

( * ) Notice: Subject to any disclaimer, the term of this patent is extended or adjusted under 35 U.S.C. 154(b) by 79 days.

(21) Appl. No.: 13/357,865

(22) Filed: Jan. 25, 2012

(65) Prior Publication Data

US 2012/0187012 A1 Jul. 26, 2012

Related U.S. Application Data

(60) Provisional application No. 61/435,967, filed on Jan. 25, 2011.

(51) Int. Cl.
*B65D 85/00* (2006.01)

(52) U.S. Cl.
USPC ..... 206/586; 206/453; 206/521

(58) Field of Classification Search
CPC .. B65D 75/004; B65D 81/054; B65D 81/057; B65D 81/055; B65D 5/5033
USPC ..... 206/586, 453, 320, 521, 497, 588, 592
See application file for complete search history.

(56) References Cited

U.S. PATENT DOCUMENTS

| | | | | |
|---|---|---|---|---|
| 2,050,791 | A * | 8/1936 | Graham | 206/521 |
| 5,271,498 | A | 12/1993 | Gillespie | |
| 5,407,078 | A | 4/1995 | Strauser | |
| 5,450,965 | A | 9/1995 | Cox | |
| 6,273,257 | B1 | 8/2001 | Mossbeck | |
| 7,147,106 | B2 | 12/2006 | Kowalski et al. | |
| 7,383,676 | B1 | 6/2008 | Schmidt et al. | |
| 2005/0161363 | A1 * | 7/2005 | Kowalski et al. | 206/497 |
| 2008/0054061 | A1 | 3/2008 | Bostian | |

FOREIGN PATENT DOCUMENTS

| | | | | |
|---|---|---|---|---|
| JP | 03085269 A * | 4/1991 | | B65D 81/06 |

* cited by examiner

*Primary Examiner* — David Fidei

(57) ABSTRACT

A mattress package having a barrier layer which encapsulates the entire mattress, two skid pads which cover and protect the top and bottom portion of the mattress, and two side trays which cover and protect the left and right sides of the mattress. The side trays cover a portion of the skid pads and the entire assembly is banded by two or more securing bands. Two or more handles are positioned on the front and back surfaces of the side trays on both the left and right sides. The handles provide grips for the mattress package to facilitate handling. The mattress package provides sufficient strength and protection to the mattress while utilizing a minimal amount of packaging materials.

10 Claims, 5 Drawing Sheets

MATTRESS PACKAGE

RELATED APPLICATIONS

This patent application claims priority to U.S. Patent Application No. 61/435,967, filed on Jan. 25, 2011. The aforementioned United States Patent Application is incorporated by reference herein in their entirety.

FIELD OF THE INVENTION

The present invention pertains generally to packaging and protective covering, and more particularly to packaging for mattresses or other products of similar characteristics, shapes or dimensions.

BACKGROUND OF THE INVENTION

The packaging of mattresses for shipping, distribution, handling and eventual sale presents a formidable challenge given the size and nature of the product. Mattresses are too large for practical packaging in a separate container such as a box, yet must have substantial protection from damage and soiling to maintain the "as new" condition required for retail marketing and sale. This has led to the widespread use of heavier gauge plastic film as a wrapping material which encapsulates the mattress. The formation of a plastic film package about a mattress has been automated, as descried for example, in U.S. Pat. Nos. 5,934,041, 6,178,723 and 6,273,257. These packages typically produce a fused seam of the plastic sheet material about the perimeter of the mattress which, although strong enough to keep the sealed plastic package intact, does not provide any greater barrier than the inherent strength of the plastic sheet material. The strength of this type of packaging is in many instances inadequate to protect the product completely from the factory to final installation in a purchaser's bedroom. This is largely due to the substantial size and weight of modern day mattresses, and the handling tendency to stock and move the so-packaged mattress along the peripheral border. Because such package has no built-in gripping points, the plastic material is further stressed by gripping of a section of material by the handlers. Once the plastic is torn, either as a result of such handling or from abrasion, the mattress upholstery is readily exposed to soiling and damage, which significantly reduces the retail value or even prevents retail sale of the product. Given the substantially cost and handling requirements of these types of products, returns and recalls due to failure of the packaging are extremely costly to the manufacturer.

Thus there is a need for a mattress package which provides adequate protection while providing convenient gripping points and which utilizes a minimal amount of material.

SUMMARY OF THE INVENTION

The mattress packaging of the present disclosure and related inventions is described herein as having a barrier layer which substantially encloses a mattress, two skid pads which are positioned over a top side and a bottom side of the mattress and over the barrier layer, and two side trays having a floor and four side walls, the four side walls having a plurality of apertures thereon which serve as gripping points. A first side tray is positioned over the right side of the mattress and a second side tray is positioned over the left side of the mattress and the two side trays are secured to the mattress using two or more removable straps which wrap around the mattress package.

In another aspect of the invention, a mattress package is described as having a substantially rectangular mattress having a top surface, a bottom surface opposite and parallel to the top surface and four side walls perpendicular to and extending between the top and bottom surface, a barrier layer comprising two sheets of material which are closed around a mattress on four sides, a first skid pad which comprises a u-shaped channel having a floor and two side walls wherein a first side wall of the mattress is inserted into the u-shaped channel, a second skid pad which comprises a u-shaped channel having a floor and two side walls wherein a second side wall of the mattress, located opposite the first side, is inserted into the u-shaped channel, a first side tray which comprises a floor, two side walls and two end walls, wherein a third side of the mattress is inserted into the first side tray, and a second side tray which comprises a floor, two side walls and two end walls, wherein a fourth side wall of the mattress is inserted into the second side tray and at least two removable straps attached horizontally around the mattress over the first and second side trays.

DETAILED DESCRIPTION OF PREFERRED AND ALTERNATE EMBODIMENTS

Figure 1:
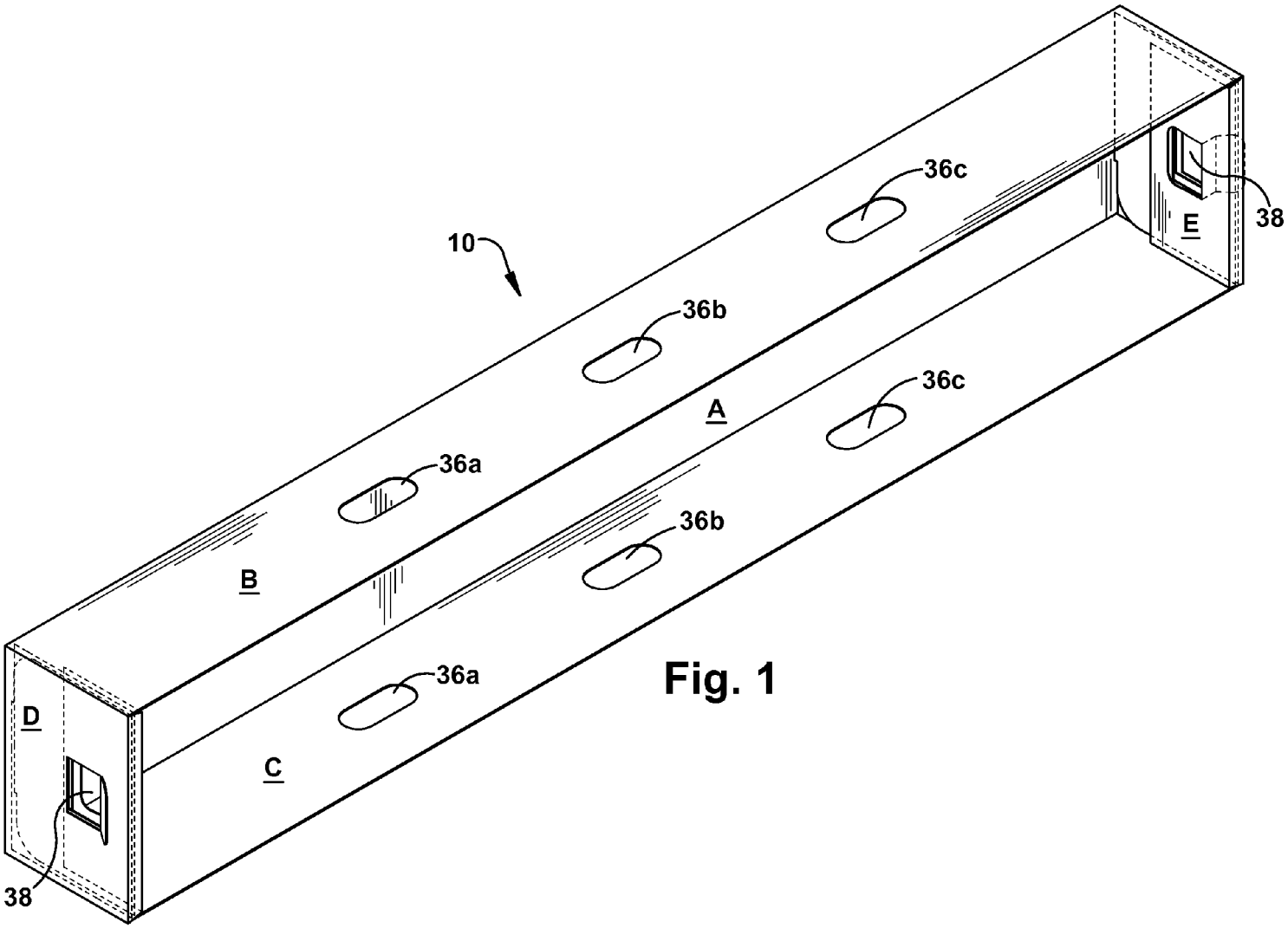
FIG. 1 is a perspective view of a side tray of the Mattress Package of the present invention.

The mattress packaging of the present disclosure and related inventions provides sufficient protection to the mattress while minimizing the amount of materials used. The packaging material includes a plastic wrapping or bag, two cardboard skid pads, and two cardboard side trays.

A barrier layer 42 (shown in FIG. 4) is first positioned around the mattress 50 to protect the mattress 50 from dirt, debris, rain, snow or any other substance coming in contact with the mattress 50. In a preferred embodiment, the barrier layer 42 is a 4-mil polyethylene bag-like structure, although any suitable material producible in sheet or bag form and which can be sealed by thermal or mechanical means can be used. The barrier layer 42 envelopes the entire mattress 50 and includes one open end through which the mattress is inserted. Once the mattress 50 is completely covered by the barrier layer 42, the open end is closed using an adhesive or other thermal or mechanical closing mechanism.

Two skid pads 40 are used to protect the top and bottom sides of the mattress perimeter 52. Each skid pad 40 consists of a single piece of cardboard having two fold lines along which each skid pad 40 is folded to form a U-shaped channel having a floor and two side walls into which each end of the mattress is inserted. The skid pads 40 protect the top and bottom sides and border of the mattress 50.

Figure 2:
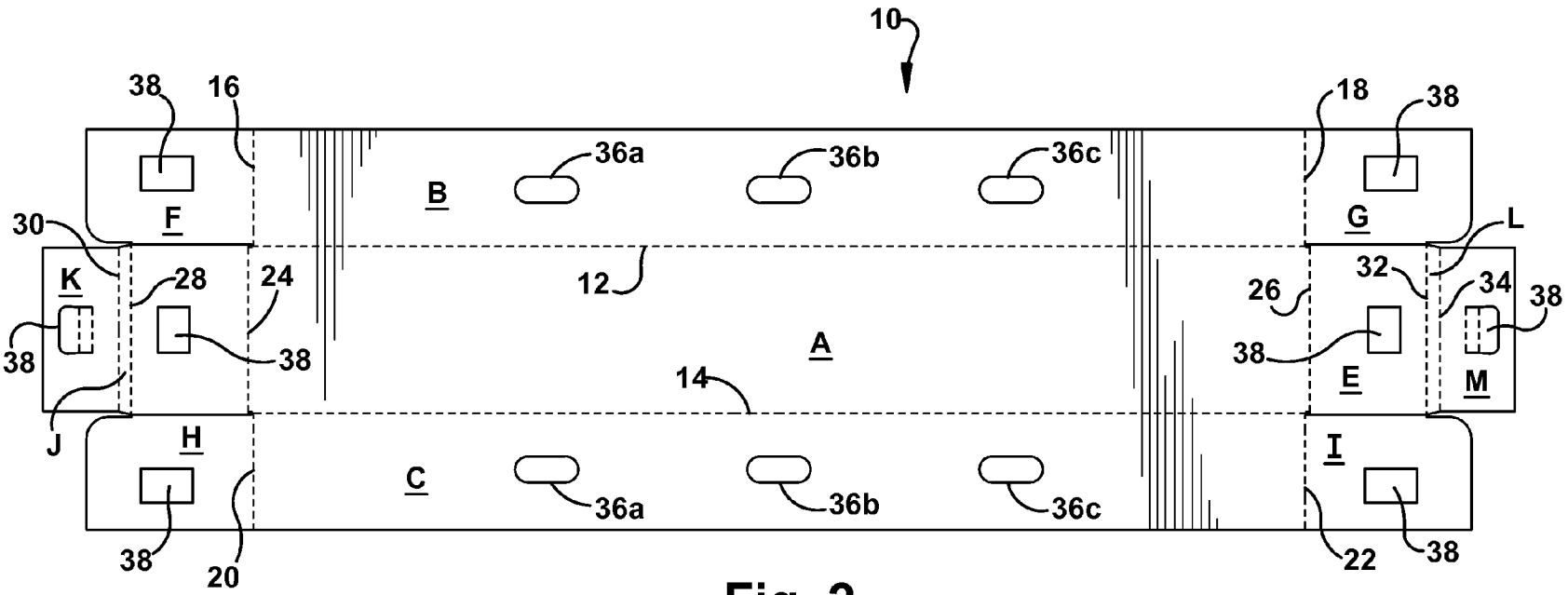
FIG. 2 is a top view of a representative die cut of a side tray used in the Mattress Package of the present invention.

A fully assembled side tray 10, shown in FIG. 1 includes a floor A or bottom and four side walls B, C, D, E with an open top through which a long side of a mattress 50 is inserted. A die cut of a side tray 10 is shown in FIG. 2. The side tray 10 contains three elongate panels. A main panel A is connected to a first side panel B along a first fold line 12 and a second side panel C along a second fold line 14. In a preferred embodiment, the main panel A, first B and second C side panels are each approximately 81¼" long, with the main panel A being approximately 12 13/16" wide and each of the first B and second side panels being approximately 8⅞" wide. Side tab F is connected to one distal end of side panel B along fold line 16 and side tab G is connected to the opposite distal end of side panel B along fold line 18. Side tab H is connected to one distal end of side panel C along fold line 20 and side tab I is connected to the opposite distal end of side panel C along fold line 22. End tab D is connected to one distal end of main panel A along fold line 24 and end tab E is connected to the opposite distal end of main panel A along fold line 26. End tab D is further connected to intermediate tab J along fold line 28 and intermediate tab J is connected to locking tab K along fold line 30. End tab E is further connected to intermediate tab L along fold line 32 and intermediate tab L is connected to locking tab M along fold line 34.

As further shown in FIG. 2, side panels B and C each contain three apertures 36 which are evenly spaced apart from the horizontal center of the panel. Each aperture 36 is approximately five inches wide having a substantially oval shape to accommodate the hand of a user. Two outer apertures 36*a*, 36*c* are strategically positioned approximately 20 inches from each end of each side panel with approximately 12 13/16 inches between a center aperture 36*b* and the two outer apertures 36*a*, 36*c*. Each aperture is used as a gripping point or handle for ease of lifting and transporting a mattress 50 contained therein. Each of the side tabs F, G, H, I, end tabs D, E and locking tabs K, M also contain an aperture 38 thereon which correspond to handles or gripping points located at the distal ends of each side tray 10. The handles or apertures 38 located at each short end of each side tray 10 are substantially rectangular being approximately 3.5 inches wide and 2.5 inches tall. The three handles 36*a*-36*c* run along each of the side panels B, C so that when the side trays 10 are inserted over the side perimeter of a mattress 52, handles or gripping points are available on both the front and back side of the mattress 50 and also on both the left and right sides of the mattress 50 to facilitate lifting, pushing, pulling or otherwise moving the enclosed mattress 50.

Figure 5:
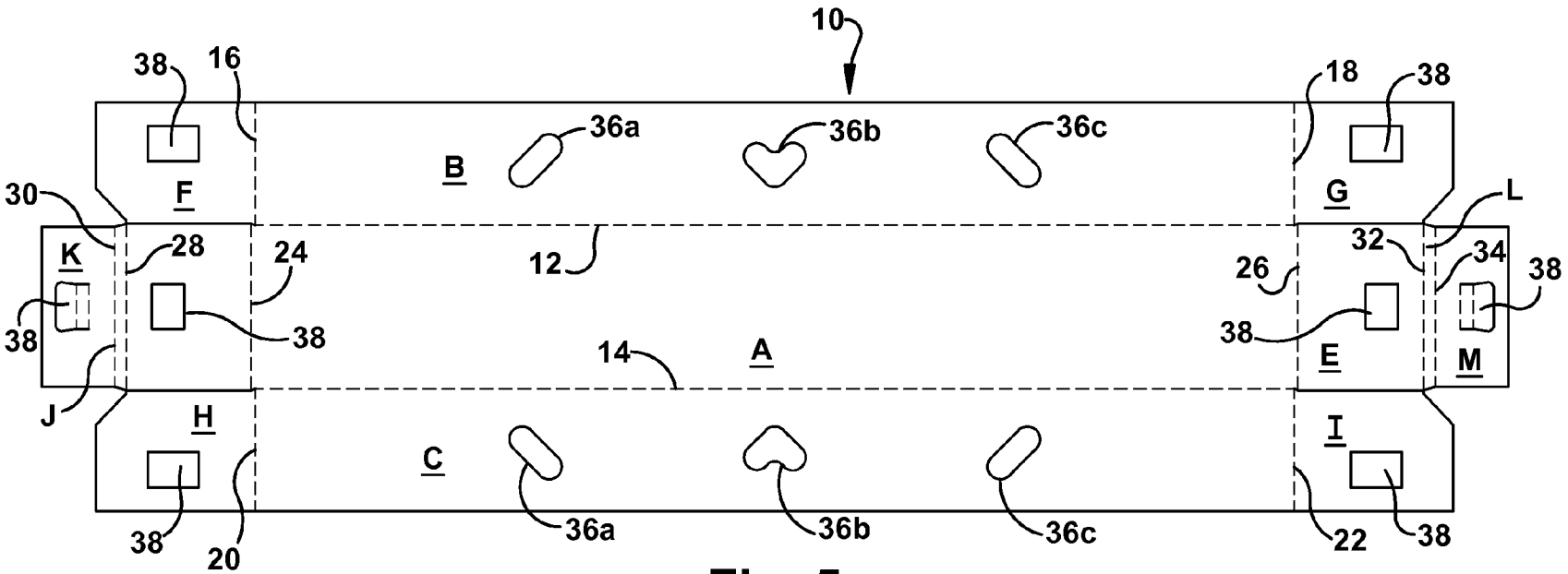
FIG. 5 is a top view of a representative die cut of an alternate embodiment of the side tray used in the Mattress Package of the present invention.

An alternate embodiment of side panels B and C is shown in FIGS. 5-7. The outer apertures 36*a*, 36*c*, are positioned at a 45-degree angle with respect to the horizontal top edge of the panel. Both apertures are angled outward so they are each slanting in a different direction, as shown in the figures. The center aperture 36*b* has an inverted heard shape and is located at the horizontal center of each panel. Each side of the inverted-heart shape is positioned approximately 45-degrees from the horizontal bottom edge of each panel. Each of the outer apertures 36*a*, 36*c* is approximately 5-inches long and approximately 2-inches wide, with the center aperture 36*b* being approximately 4-inches wide.

To construct the side trays 10 from the die cut, side panels B and C are folded upward along fold lines 12 and 14 so that they are perpendicular to main panel A. Next, side tab pairs F and H and G and I are folded inward along fold lines 16 and 20 and 18 and 22 respectively. Then, end tabs D and E are folded upward so that each end tab is parallel with folded side tabs F and H and G and I. The end tab is folded along lines 28 and 30 and 32 and 34 so that locking tabs K and M are folded downward over the inside surface of end tabs D and E respectively so that the apertures located on each of the panels K and D and M and E are in alignment. Locking mechanisms N and O are then folded through the upper edge of the aligned apertures located in tabs K and D and M and E to secure the panels together in their upright position, forming two end walls with openings 38 which serve as handles or gripping points at each end of the side tray.

Figure 3:
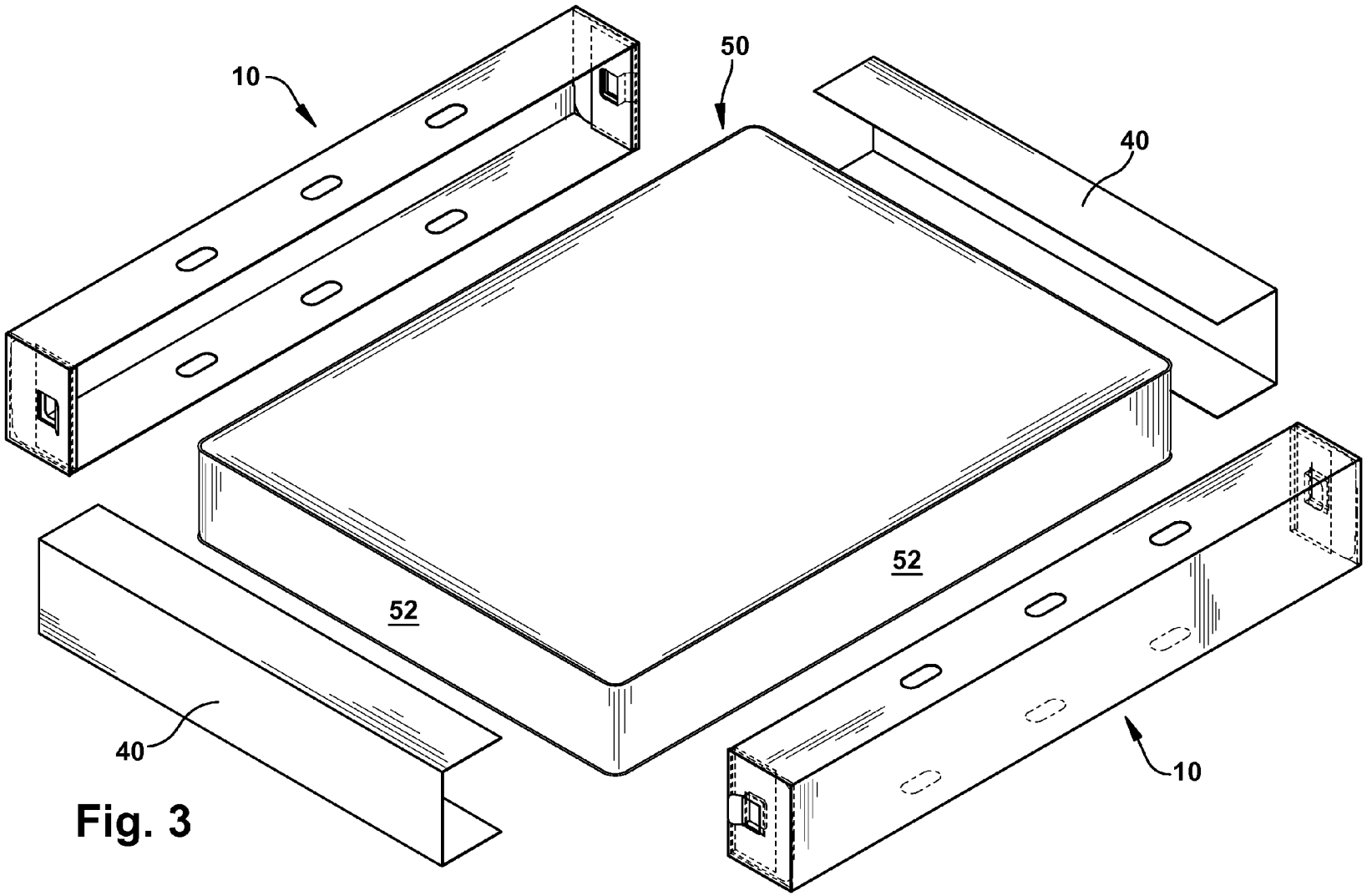
FIG. 3 is an exploded view of a mattress and components of the Mattress Package of the present invention.
Figure 4:
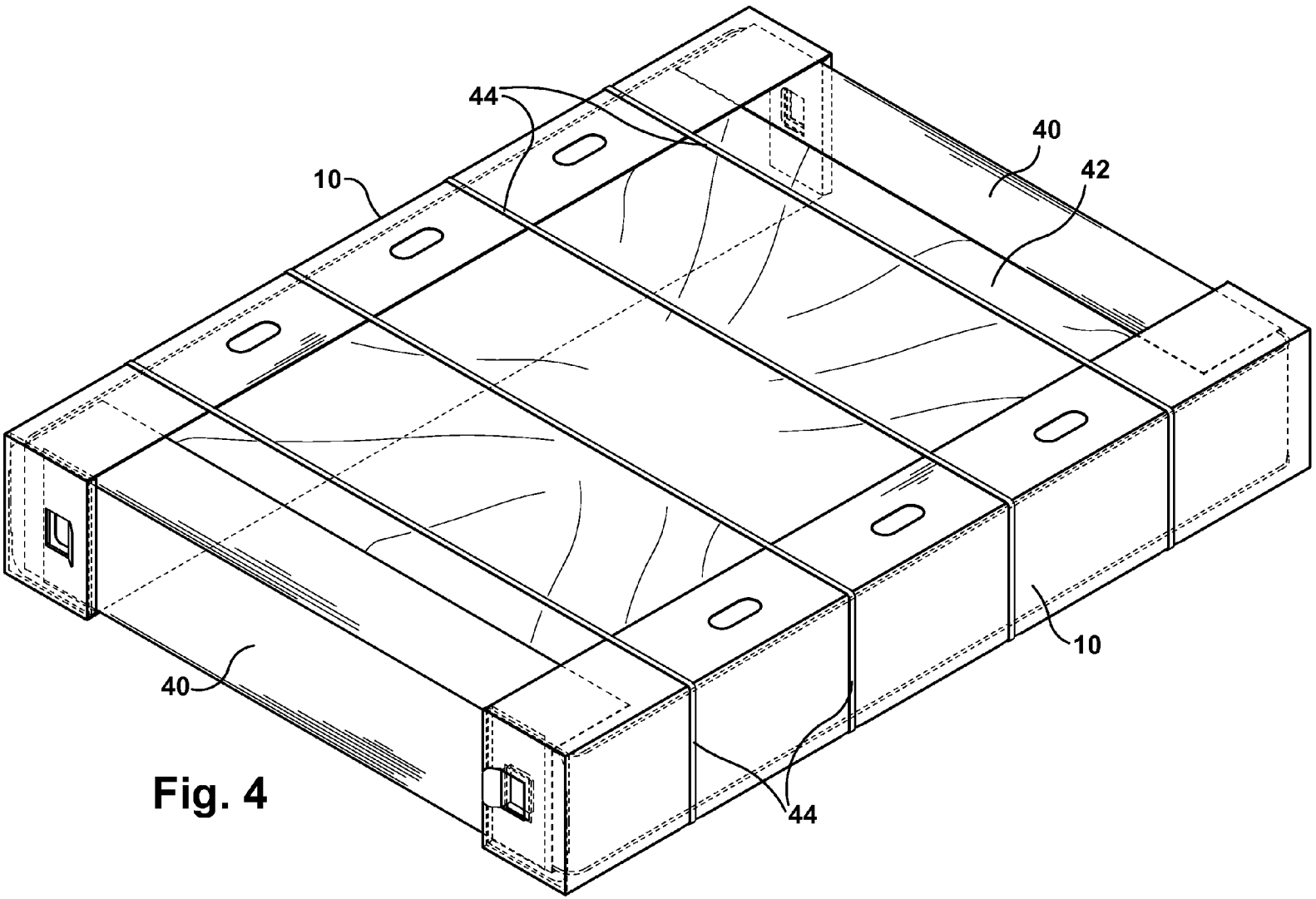
FIG. 4 is a perspective view of a fully assembled Mattress Package of the present invention.

An exploded view of a mattress with packaging components is shown in FIG. 3. Once top and bottom mattress 50 ends are inserted into each of the skid pad channels 40, the side trays 10 are inserted over the right and left sides of the mattress perimeter 52. The side trays 10 partially extend over each skid pad 40, as shown in FIG. 4, to secure each skid pad 40 to the top or bottom mattress ends. Once the skid pads 40 and side trays 10 are in place, the entire mattress 50 with packaging is banded by two or more, preferably four, plastic straps or bands 44 to secure the side trays 10 to the mattress 50. The straps or bands 44 should bind the packaging to the mattress 50 without obstructing use of the handles 36*a*-36*c*, 38. The vertical sides of the mattress and a portion of the horizontal surfaces of the mattress proximate to the border are protected by the frame-like structure created by the two skid pads 40 in combination with the two side trays 10. The sides and border 52 of the mattress are particularly vulnerable or susceptible to damage because, due to the large size and weight of mattresses, they are often moved by pushing, pulling or sliding the mattress along while it is in a vertical position, resting on either the left or right side of the mattress or on the top or bottom side of the mattress. The frame-like structure also makes it conducive to stack the mattresses horizontally during loading, unloading, shipping or storage thereof. The skid pads 40 and side trays 10 may have increased strength and durability by using double walled corrugated cardboard.

FIG. 5 illustrates an alternate embodiment of a side tray 10 with openings 36*a*, 36*b* and 36*c* which are configured and oriented for ergonomic gripping and handling of the package.

Compared to traditional mattress packaging, which may consist in one form of several layers of heavy gauge plastic which is wrapped several times around a mattress, the mattress package of the present invention provides a less costly solution by using inexpensive material, namely, cardboard and polyethylene. The packaging of the present invention also provides increased visibility of the mattress at arrival, including the mattress tag or label. This provides the opportunity to inspect the mattress without having to open the packaging. The frame-like packaging in combination with the barrier layer minimizes the amount of material that is used which in turn generates less waste.

What is claimed is:

1. A mattress package comprising:

a substantially rectangular mattress having a top surface, a bottom surface opposite of and parallel to the top surface, and four side walls perpendicular to and extending between the top and bottom surface;

a barrier layer comprising two sheets of material which are closed around a mattress on four sides;

a first skid pad which comprise a u-shaped channel having a floor and two side walls, wherein a first side wall of the mattress is inserted into the u-shaped channel;

a second skid pad which comprises a u-shaped channel having a floor and two side walls wherein a second side wall of the mattress, located opposite the first side, is inserted into the u-shaped channel;

a first side tray which comprises a floor, two side walls and two end walls, wherein a third side wall of the mattress is inserted into the first side tray;

a second side tray which comprises a floor, two side walls and two end walls, wherein a fourth side wall of the mattress is inserted into the second side tray; and at least two removable straps attached horizontally around the mattress over the first and second side trays.

2. The mattress package of claim 1, wherein the first and second skid pads and the first and second side trays are made of double walled corrugated cardboard.

3. The mattress package of claim 1, wherein the harrier layer is a bag-like structure having three closed sides and one open side which is sealed after the mattress is inserted therein.

4. The mattress package of claim 1, wherein the barrier layer is transparent.

5. The mattress package of claim 1, wherein a significant portion of the top and bottom surface of the mattress is visible through the mattress package.

6. The mattress package of claim 1, wherein a portion of the first and second side trays extend over a portion of the first and second skid pads.

7. The mattress package of claim 1, wherein the first and second side trays each contain a plurality of handles thereon.

8. The mattress package of claim 1, wherein there are at least two handles on a top side wall of the mattress and at least two handles on a bottom side wall of the mattress.

9. The mattress package of claim 1, wherein the two side trays only extend over a portion of the top and bottom surface of the mattress.

10. The mattress package of claim 1, wherein the barrier layer is made of polyethylene.

* * * * *